US005331778A

United States Patent [19]

Mazpule et al.

[11] Patent Number: 5,331,778

[45] Date of Patent: Jul. 26, 1994

[54] PORTABLE ENCLOSURE ASSEMBLY

[76] Inventors: Antonio Mazpule, 4711 SW. 133rd Ave., Miami, Fla. 33175; Geronimo R. Pimienta, 1233 SW. 13th Ct., Miami, Fla. 33175

[21] Appl. No.: 910,535

[22] Filed: Jul. 8, 1992

[51] Int. Cl.[5] ..... E04B 2/72; E04H 1/12

[52] U.S. Cl. ..... 52/79.5; 52/36.4; 52/264; 52/266; 52/271; 52/286; 52/591.1; D25/16

[58] Field of Search ..... 52/79.5, 79.1, DIG. 14, 52/286, 284, 285, 266, 264, 270, 271, 36.1, 36.4, 36.5, 82, 79.6, 593; D25/16

[56] References Cited

U.S. PATENT DOCUMENTS

| | | | |
|---|---|---|---|
| D. 115,963 | 8/1939 | Gledhill | D25/16 |
| 3,820,292 | 6/1974 | Fitzpatrick | 52/82 |
| 4,031,572 | 6/1977 | Harding | 52/79.1 |

FOREIGN PATENT DOCUMENTS

| | | | |
|---|---|---|---|
| 2471454 | 6/1981 | France | 52/79.5 |

*Primary Examiner*—Michael Safavi

[57] ABSTRACT

A portable enclosure designed to be mounted in any desirable location and defined by a plurality of wall segments arranged in a vertically stacked array wherein each wall segment includes a plurality of wall panels interconnected to one another so as to partially surround and thereby define a vertically oriented interior of sufficient dimension and configuration to house a person in an upstanding position. Supplementary attachments including a hose bib and water supplying hose or like water source may be attached such that the person within the interior of the enclosure may take a shower. Anchor structures are provided to secure the enclosure to the ground or other applicable supporting surface. The various components of the enclosure assembly may be easily assembled and disassembled to facilitate storage and or transport. In another embodiment the portable enclosure may be positioned in a horizontal enclosure and the position may be used as a sleeping enclosure wherein a main entrance is disposed in contiguous relation to the supporting ground and wherein one open end now defines the "crawl in" entrance for the person designed to be housed when sleeping by the portable enclosure.

16 Claims, 5 Drawing Sheets

-29-
-27-
-23-

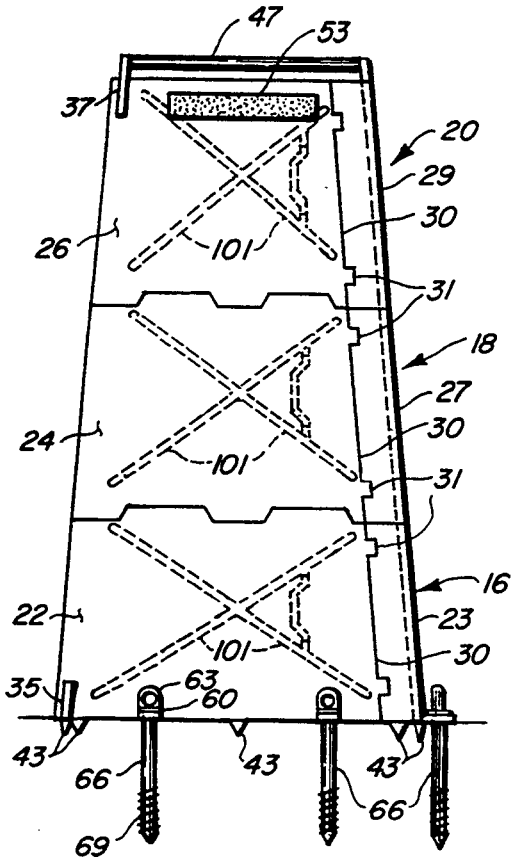
FIG. 5
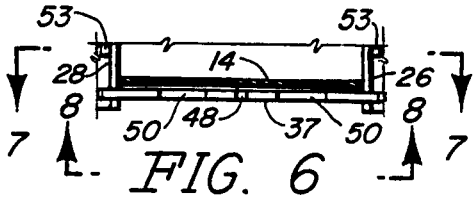
FIG. 6
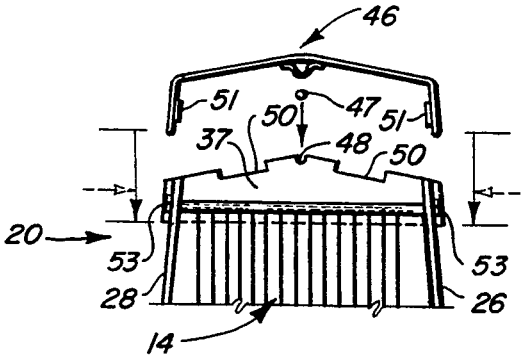
FIG. 7
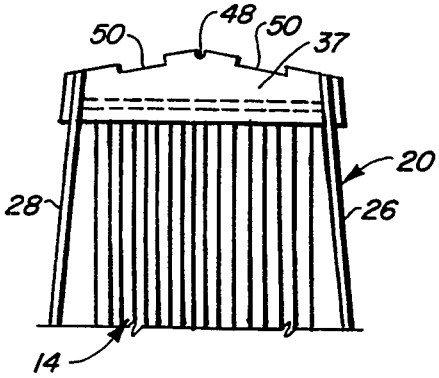
FIG. 8
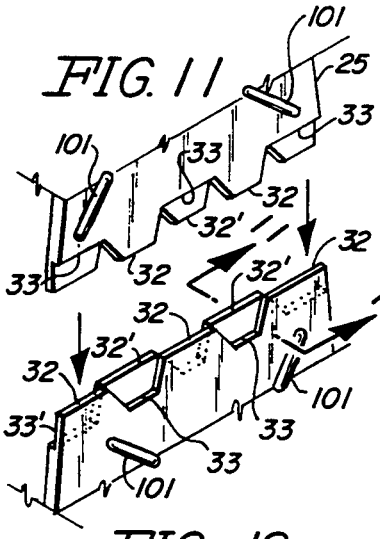
FIG. 11
FIG. 12
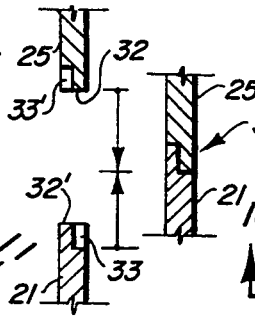
FIG. 13
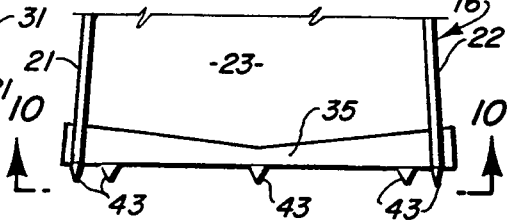
FIG. 9
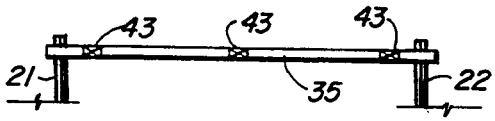
FIG. 10

PORTABLE ENCLOSURE ASSEMBLY

BACKGROUND OF THE INVENTION

1. Field of the Invention

This invention relates to an enclosure which may be easily assembled and disassembled at any given site and accordingly which is effectively portable in nature such that a grown person can be positioned within the interior of the enclosure in an upstanding position for various purposes such as but not limited to changing clothes, taking a shower, etc.

2. Description of the Prior Art

In modern day society there is usually found an increasing amount of time which may be dedicated to recreational activity. Much of this time is directed to outdoor activities such as but not limited to swimming, sunbathing, camping, hunting, fishing, etc. All of these activities, after they are completed, frequently involve the participants wanting to take showers, change clothes, or the like. However enclosures specifically designed to allow such activities are not normally available except at certain permanently built publicly available sites where large numbers of people congregate.

There is therefore a need in this area for an enclosure or housing type of structure which is portable in nature at least to the extent that it may be easily assembled or disassembled at any given site utilizing a minimal amount of effort on the users part and requiring no exceptional talent, training, tools or auxiliary equipment required to assemble or disassemble such enclosures.

Numerous types of enclosures and or portable shower type housing units are well known in the prior art as evidenced by the following United States patents.

Gatley U.S. Pat. No. 3,391,409 discloses a portable shower bath apparatus which is not necessarily designed for outside use but which is certainly capable of being used in an outdoor location. This device includes a support frame formed of tubing which may be interconnected in its various segments to define an interior which may be enclosed by a drapery, curtain or like structure. This device while applicable is somewhat lightweight in overall design and construction and does require tooling and or a certain amount of expertise in its assembly and disassembly. In addition the tubular components define a frame which is meant to support a water container in an overhead location relative to the interior in which a user or participant may be positioned for showering.

Mustee discloses a free standing shower stall including a base and one or more wall panels used to impart rigidity to the stall. A drain structure is also located in the base and the wall panels are made and joined together by imperforate watertight hinges which permit the panels to be folded upon themselves for shipment when in a stored position and wherein such folding may occur in association with other parts of the stall.

The patent to Sedala U.S. Pat. No. 4,807,310 also is directed to a portable shower stall having a plurality of corner posts and upright wall elements which are removably secured to and supported by such corner posts. The outer or lower most end of the post are designed to engage and be supported on some type of surface and are particularly pointed at the ends thereof to penetrate a ground like area if such is defined as a supporting surface. Hoses, plumbing and like installations including a shower head may be mounted on the interior and communicate with an exterior source through a hose or like structure. The individual wall panels supported by the post may have a plurality of shingle type structures and may be vented to allow air flow through the interior of the stall.

The patents to Westerweller, U.S. Pat. No. 4,539,720 and Greenleaf, U.S. Pat. No. 4,453,280 are both directed to portable shower stall type structures which are capable of being folded or otherwise disposed into a stored position and carried by some type of facility such as a backpack type of arrangement (Westerweller) or in a separate compact carrying case (Greenleaf). These structures are of course portable in nature and are formed of a plurality of components which are significantly light in weight to the extent that these portable stalls or enclosures may be carried on or by the person with little problem. While such lightweight construction has certain advantages it does not add to the permanency of the structure while allowing the versatility of a knockdown device as is obviously needed in this area.

The above noted devices are considered to be operable and utilitarian for their intended function. However they do not solve the problem of establishing an enclosure or like housing structure which may be used as a shower stall or otherwise used for other activities such as changing clothes and the like whether or not a shower is attached thereto. In such a preferred device a certain permanency or feeling of structural integrity must be conveyed to the users of such a device while at the same time such a device must be capable of being easily assembled and disassembled. In addition a preferred structure of the type set forth herein should also be capable of having auxiliary or supplementary attachments made thereto such as but not limited to tables for supporting various goods and or performing other functions such as eating or the like.

SUMMARY OF THE INVENTION

The present invention relates to a portable enclosure or like housing structure which may be used by an occupant for a variety of purposes such as but not limited to taking a shower, changing clothes as well as other activities wherein privacy is desired. The enclosure assembly is portable to the extend that the various components which define the subject enclosure assembly may be removably connected to one another and thereby easily assembled and disassembled without the need of any special training or sophisticated tools or the like. Therefore the enclosure can be readily assembled at any convenient location and left standing due to the advantage of secured structural integrity. Alternately the enclosure can be readily dismantled in a short period of time and therefore only left standing for a short period such as for a days outing at the beach or the like.

The subject enclosure assembly includes a wall means. The wall means comprises a plurality of wall segments which collectively at least partially surround and thereby define a hollow interior of the enclosure. This hollow interior by virtue of the configuration and dimension of the plurality of wall segments is sufficient to enclose at least one person in a standing or upright orientation. More specifically the wall segments are arranged in a vertically stacked array so as to create sufficient height of the overall enclosure assembly as well as the interior thereof to allow a grown person to maintain a standing or upright position.

Each of the wall segments comprises a plurality of wall panels which are preferably three in number.

Therefore each wall segment preferably comprises two spaced apart substantially opposed side panels and an interconnecting back panel. Each of the side panels have a free peripheral edge disposed in spaced apart relation from the corresponding side panel of the same wall segment. Since the spacings between the side panels of each wall segment are aligned, an access opening or doorway is created for the passage of occupants into and out of the interior of the enclosure.

Removable attachment of adjacently positioned ones of the wall panels of adjacent wall segments are accomplished by the formation of an attachment means along corresponding, mating peripheral edges of adjacently positioned panels. The attachment means comprises at least one but preferably a double row of alternating tongue and groove structural portions. Such tongue and groove structures are adapted such that a tongue of one wall panel removably fits into a groove or recess of an adjacent wall panel to which it is attached.

The back panels include and/or are structurally adapted to interconnect the side panels of any given wall segment. Further each of the back panels are arranged in a vertically oriented, substantially stacked array such that they are correspondingly positioned peripheral edges removably interconnect to one another in the same fashion by virtue of the tongue and groove adaptation along with corresponding peripheral edges thereof.

A roof structure is provided to overlie and substantially cover an upper opening of the upper most wall segment. Associated components of the roof portion includes means to connect and or position a supply of water such as but not limited to a garden hose which may have a shower head attached thereto. Other facilities for supplying water and mounting such water supply in an overhanging relation to the hollow interior for purposes of showering on the interior of the enclosure, may be included in the aforementioned roof portion.

Connecting means are provided in the form of upper and lower tie panels which interconnect spaced apart side panels of at least an upper most and lower most wall segment. In a preferred embodiment, to be described in greater detail hereinafter there are preferably three such wall segments arranged in a vertically stacked array such that they may be defined as a lower most wall segment, an upper most wall segment and a middle wall segment. Each of such uppermost, lowermost and middle wall segments include the same number of wall panels which, as set forth above, are defined by spaced apart side wall panels and a back or rear wall panel.

Other structural features of the present enclosure assembly include anchoring means which includes an anchor flange selectively positionable between an outwardly extending operative position or an inwardly folded position. Such anchor flanges are movably attached to certain ones of the panels of the lower most wall segment. In operation the aforementioned stored position of each of the anchor flanges is in a co-planer relation to the remainder of the panel to which it is attached. The outward extension of these anchor flanges serves to position them over and or in overlying, confronting relation to a supporting surface such as the ground or the like. Each of these flanges has an aperture through which an anchoring pin may pass so as to penetrate, at least to some extent the supporting surface which may be the ground.

Other auxiliary features of the present invention include the provision of a table like structure including a table top having a somewhat horizontal orientation and a flat planer receiving and supporting surface. One end of the table is secured by removably attached gusset members directly to an exterior surface of one of the wall segments. The table extends outwardly therefrom and is supported by a sufficient support means, including a leg type structure which is pivotal into and out of a stored position and is secured adjacent substantially one outer most end of the table.

The present invention therefore is directed to an enclosure assembly which has sufficient structural integrity to be considered and provide the "feel" of a permanent type of housing or enclosure. However the versatility of the subject enclosure assembly is such as to allow easy assembly or disassembly to facilitate at least semi permanent installation and set up of such an enclosure or alternately allowing the user to merely set up and utilize the subject enclosure for a few hours.

Another feature of the present invention is that the exterior surface of any or all of the various wall panels may have advertising or any other similar type of decorative or informative indicia printed thereon. Such printed indicia may be used for commercial purposes such as in advertising or for other purposes such as to increase the overall aesthetic appearance of the assembly or for informative or educational purposes such as identifying one such structure from another.

BRIEF DESCRIPTION OF THE DRAWINGS

For a fuller understanding of the nature of the present invention, reference should be had to the following detailed description taken in connection with the accompanying drawings in which:

FIG. 5 is a side view of the embodiment of FIGS. 1, 2 and 4.

FIG. 6 is a top view and partial section and cutaway of the attachment of a roof assembly.

FIG. 7 is a view along line 7—7 of FIG. 6 in partial cutaway an exploded form of a roof component of the subject assembly.

FIG. 8 is a view along line 8—8 of FIG. 6.

FIG. 9 is a cutaway view of a lower portion of the subject assembly.

FIG. 10 is a top view and partial cutaway of a bottom portion of the device along line 10—10 thereof.

FIG. 11 is cutaway view showing an attachment structure for interconnecting panels of the present invention.

FIG. 12 is a cooperative partial cutaway view relative to FIG. 11.

FIG. 13 is a cutaway view in partial exploded form showing the connection of the panels of FIGS. 11 and 12.

Like reference numerals refer to like part throughout the several views of the drawings.

DETAILED DESCRIPTION OF THE PREFERRED EMBODIMENT

Figures 1, 14, 15, 16, 17, 20:
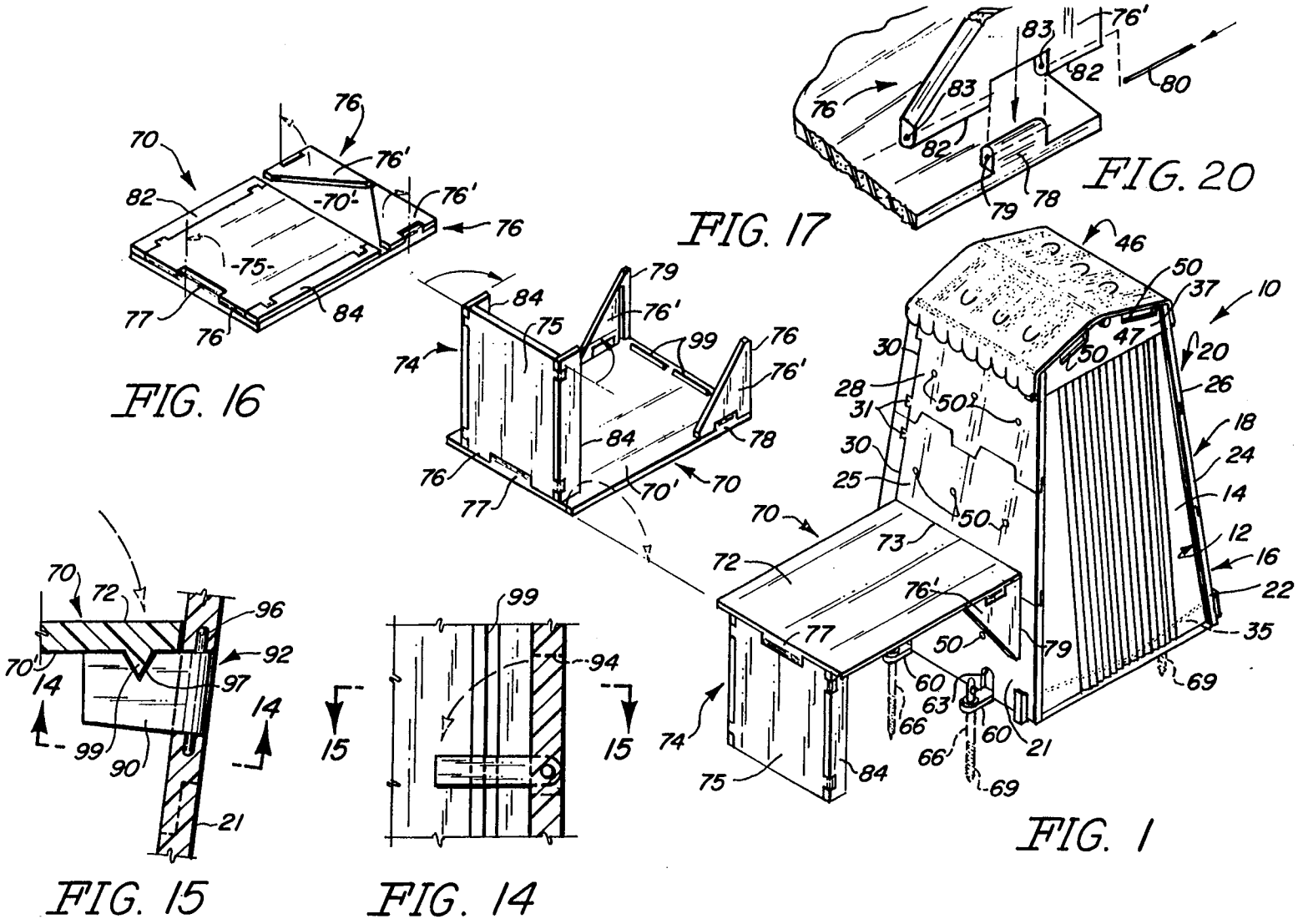
FIG. 1 is a perspective view of the subject enclosure assembly in its assembled state.
FIG. 14 is a detailed view and partial cutaway and section of an auxiliary table structure associated with the subject assembly.
FIG. 15 is a side view and partial section and cutaway of the embodiment of FIG. 14.
FIG. 16 is the perspective view of the table assembly in a compact or stored or orientation.
FIG. 17 is a perspective view of the embodiment of FIG. 16 in an open and operative position.
FIG. 20 is a perspective view in partial form cutaway and section showing details of the support structures associated with the table of the embodiment of FIGS. 14 through 17.
Figures 2, 3, 4:
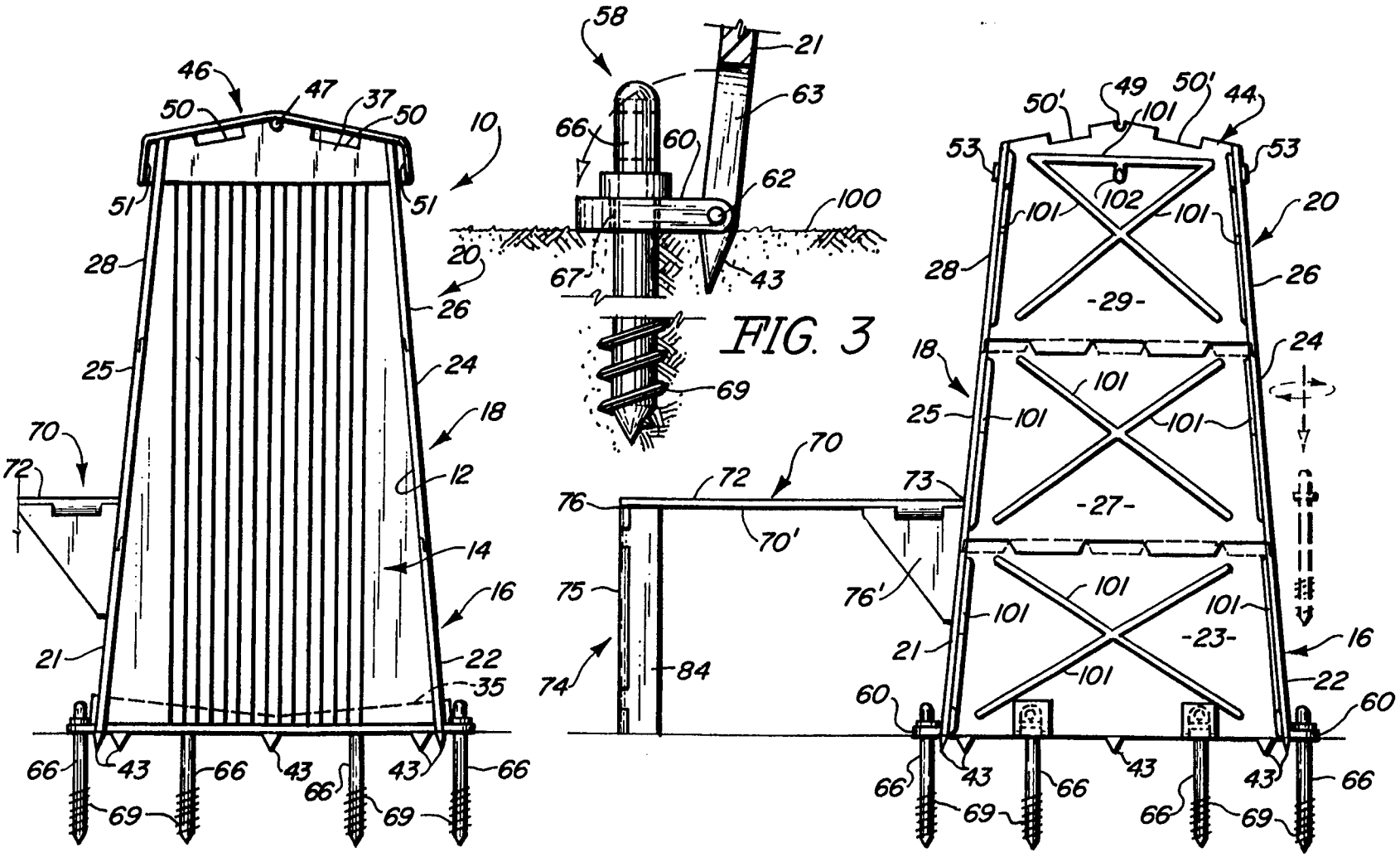
FIG. 2 is a front view and partial cutaway of the embodiment of FIG. 1.
FIG. 3 is a detailed view and partial cutaway of an anchoring assembly associated with the subject enclosure.
FIG. 4 is a rear view of the embodiment of FIG. 2.

As shown in FIG. 1, the present invention is directed towards a portable enclosure assembly generally indicated as 10 which is designed to allow at least one person to enter a hollow interior of the enclosure assembly for purposes of conducting a variety of activities such as but not limited to taking a shower, changing clothes, etc. More specifically the enclosure includes a wall means which are disposed in at least partially surrounding relation to a front access opening as indicated as 12. As shown in FIG. 1 this access opening 12 extends along the entire height of the enclosure 10 and may be covered by any type of covering facility such as but not limited to a curtain, drape, foldable slat like covering or the like which is generally indicated as 14. Again with reference to the wall means, such wall means includes a plurality of wall segments generally indicated as 16, 18 and 20. These wall segments are arranged in a vertically stacked array as shown in FIGS. 1, 2 and 4 wherein each wall segment includes a plurality of panels. The panels of the lower most wall segments 16 includes two side panels 21 and 22 and a back panel 23. The middle wall segment 18 comprises two spaced apart substantially opposed side wall panels 24 and 25 and a back panel 27. The upper most wall segment 20 includes two spaced apart side panels 26 and 28 and an interconnecting back panel as at 29. Each of the spaced apart side panels of each of the various wall segments are interconnected by the corresponding back panels. Such interconnection may occur along a hinge line as at 30 and further wherein the lateral peripheral edges of each the corresponding side wall panels may be further removably connected by virtue of a tongue and groove fit as at 31.

The stacked vertical array of the various wall segments 16, 18 and 20 is accomplished through the provision of an attachment means formed along correspondingly positioned mating peripheral edges. With reference to FIGS. 11, 12 and 13 each of the mating peripheral edges of the various wall panels include a substantially double row of tongue and groove structures. More specifically a first row may include a plurality of upwardly extending tongues 32 and alternating receiving grooves 33. The next adjacent and also integrally formed row on the same peripheral edge as shown in FIGS. 11 and 12, includes upwardly extending tongues 32' and alternating recesses 33'. It can be seen from a review of FIG. 13 that the outwardly protruding tongues of one peripheral edge such as on the peripheral edge of wall panel 25 is designed to fit within the correspondingly positioned grooves of the peripheral edge of the wall panel 21. This removable attachment allows easy assembly and disassembly of the entire wall means and the correspondingly positioned and mating wall panels and also provides a secured attachment between such wall panels in order to form the vertical stacked array as set forth above. Further with regards to FIGS. 1 and 4, it should be noted that the double rows of tongue and groove structures defining the aforementioned attachment means occurs along appropriate peripheral edges of the various panels. For example each of the panels 21, 22 and 23 of the lower most wall segment 16 has the connection means formed along its upper most peripheral edge. To the contrary the upper most wall segment 20 has such connection means formed along the lower most peripheral edges of each of the panels defined thereby. The middle wall segment 18 has the attachment means defined by the double row of tongue and groove structures extending along both its upper and lower peripheral edges for reasons that are apparent.

Other features of the wall means is the structural adaptation of each of the panels of each of the wall segments such that the inner transverse dimension or transverse dimension of the interior segment about which the lower most wall segment 16 surrounds is greater than both the middle most wall segment and the upper most wall segment 18 and 20 respectively. Therefore in a preferred embodiment of the present invention there is a progressively decreasing inner transverse dimension from the lower most wall segment 16 to the upper most wall segment 20.

The distance between the outer most or free peripheral edges of each of the side panels 21, 22; 23, 24 and 26, 28 is open to define an access opening segment. The vertical stacked orientation of each of the wall segments defines the elongated access opening extending along the entire height of the enclosure 10 which is indicated as 12.

Figure 19:
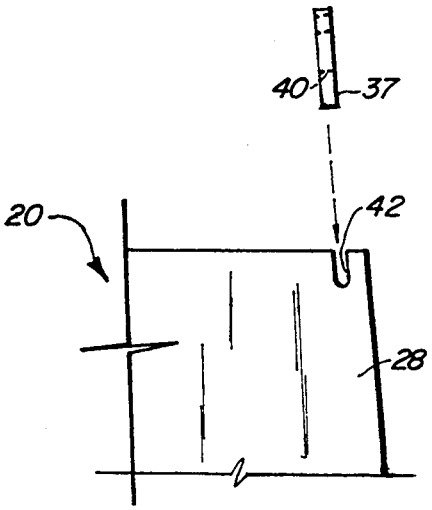
FIG. 19 is a panel and connecting structure similar to that of FIG. 18 in exploded and partial cutaway.
Figure 19A:
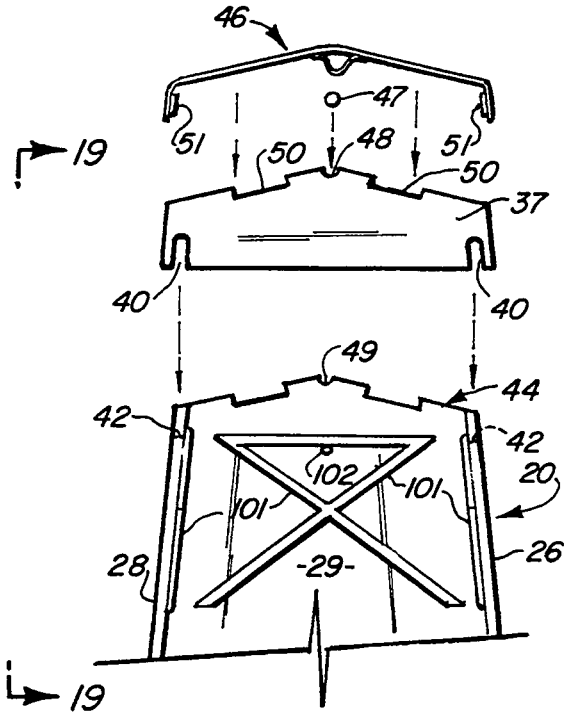
FIG. 19A is a front view in part of the embodiment shown in FIG. 19 in exploded form.
Figure 18:
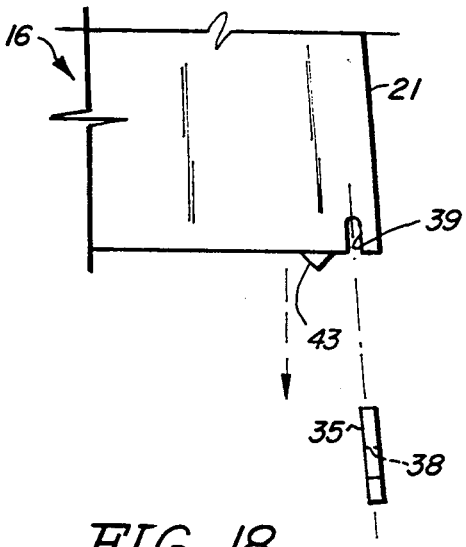
FIG. 18 is a view and partial exploded form showing inner connection of a connecting facility for attachment of the various panels to one another.
Figure 18A:
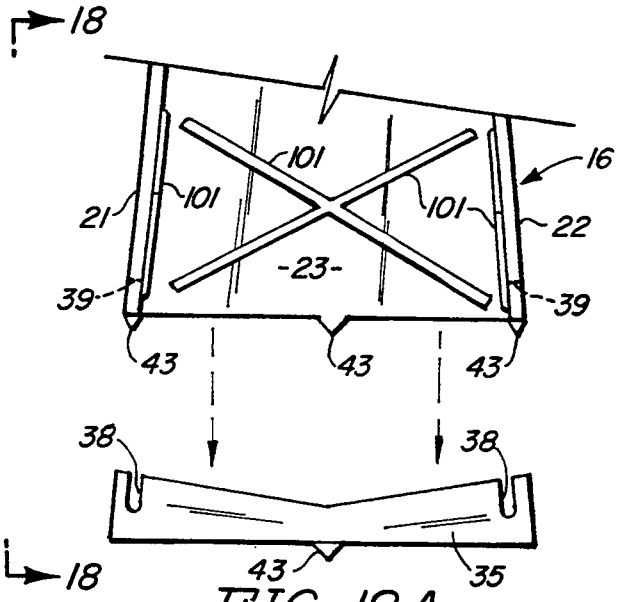
FIG. 18A is a side view of the structure of FIG. 18 shown in exploded form.

With regard to primarily FIGS. 1, 18 and 19 the subject enclosure assembly further comprises connecting means in the form of tie panels extending across and serving to interconnect spaced apart side walls of certain ones of the wall segments. In a preferred embodiment, a lower tie panel as at 35 serves to interconnect and substantially extend across the access opening segment between the outer most peripheral edges of the side panels 21 and 22 of the lower most wall segment 16. Similarly at least one upper tie panel as at 37 extends across the access opening segment between the outer or free peripheral edges of the side panels 26 and 28 of the upper most wall segment 20. The interconnection of both the lower tie panel 35 and the upper tie panel 37 is accomplished through a removable attachment wherein elongated slots as at 38 are formed in opposite ends of lower tie panel 35. These slots are designed to pass through and within the elongated slots 39 formed in correspondingly positioned ends or portions of the side panels 21 and 22. Similarly elongated slots as at 40 are formed in opposite ends of the upper tie panel 37. These slots are designed to be removably disposed to accomplish a detachable connection within the elongated slots 42 formed in the upper peripheral ends of the panels 26 and 28 of the wall segments 20.

Other features associated with the tie panels as well as the lower most peripheral edge of the panels of the wall segments 16 include penetrating spike like members as at 43 integrally formed on the lower most edges as set forth above. These penetrating spikes or like members serve to facilitate stabilization of the base or bottom of the enclosure 10 by any supporting service such as the ground or the like.

Other features of the subject enclosed assembly include a roof structure which may be formed of a variety of materials and be disposed in overlying and covering relation to an open upper end generally indicated as 44 of the enclosure. The roof structure generally indicated as 46 is sufficiently dimensioned, configured and generally adapted to be positioned in overlying relation so as to be supported at least in part above the upper peripheral edge of the upper type panel 37. An elongated supporting rod as at 47 is mounted within appropriate slots as at 48 and 49 of the upper tie panel 37 and the upper peripheral edge of the back panel 29 of the wall segment 20.

FIGS. 1 and 19 show ventilation openings as at 50 may be formed at a variety of locations in the tie panel 37 and also a plurality of such ventilation holes may also be formed in various ones of the panels of the wall means wherein such ventilation apertures or holes are indicated as 50'.

Removable attachment of the roof structure 46 is accomplished by connector elements such as but not limited to hook and loop type fastener connector strips 51 being mounted both being mounted on opposite sides of interior surface portions of the roof structure 46. These connector strips are designed to be removably connected to correspondingly positioned connector strips 53 mounted on exterior surfaces of the opposite side panels 26 and 28 of the wall segment 20.

In order to provide stabilization and secure anchoring of the enclosure 10 in the supporting surface such as the ground or the like, anchoring means are provided. Such anchoring means are disclosed in detail with reference to FIGS. 1 and 3. Such anchoring means as generally indicated as 58 include a flange as at 60 which is pivotedly mounted to a lower most wall panel as at 21, 22 and 23 by virtue of a pivot pin connection 62. By virtue of this pivotal connection, the flange or anchoring flap 60, which is centrally apertured is selectively positionable between a stored position and an operative position. The operative position is defined in FIG. 3 and in such position the flange 60 extends outwardly from the plane of the given panel to which it is attached. In the stored position the flange 60 is in a co-planer relation to the panel to which it is attached by virtue of a provision of a recess or opening as at 63. Each of the anchor flaps or flanges 60 has an opening formed therein for the passage therethrough of an anchoring stake or the like 66 as best shown in FIG. 3. The stake 66 passes through the opening 67 formed in the anchor flap 60 and may penetrate or otherwise be secured into the ground or like supporting surface 100. An auger or screw type of structure as at 69 may be formed on exterior surface portions of the anchoring stake 66 along a far end thereof as also shown in FIG. 3.

With regard primarily to FIGS. 1, 2, 4, 14 through 17 and 20, preferred embodiment of the present invention includes an auxiliary structure attachable to the portable enclosure 10. This, is in the form of a table or like supporting member generally indicated as 70. The table includes a supporting platform portion 72 being substantially horizontally oriented and having one inner most end as at 73 supported on and extending outwardly from an exterior surface of the wall means as clearly shown in FIG. 1 and 4.

The table assembly 70 includes a support means including a leg assembly 74 and one or more gusset assemblies 76 serving to support the platform 72 in its horizontal or operative position. More specifically the leg assembly 74 includes a main leg 75 having an inner most end as at 73 pivotally attached to an undersurface portion of the platform 70 as at 70'. The pivotal or hinge type connection as at 77 is defined by a structure somewhat similar to that shown in FIG. 20. A main receiving member 78 includes a central channel extending therethrough as at 79. A pivot pin or like hinge pin 80 passes through the receiving segments 82 in the object to be pivoted wherein such receiving segments 82 also include elongated central channel portions 83. These central channels 83 are aligned with the central channel 79 in the hinge support member 78. The length of the hinge pin 80 is such as to allow passage completely therethrough and thereby defining hinged connection.

It should be apparent that while with regard to FIG. 20 the pivotal connection disclosed relates to the gussets 76' rather than the main leg 75. However the pivotal connection of the main leg 75 indicated as 77 is the same.

Additional features associated with the leg assembly 74 are two end slats as at 84 pivotally secured to and extending along the length of opposite longitudinal side edges of the main leg 75. A similar hinge or pivotal type connection may be used so as to allow the positioning of the leg slat 84 into and out of co-planer relation relative to the main leg 75 as best shown in FIGS. 16 and 17. Also, by virtue of the pivotal or hinge like connection 77 the leg assembly 74 may be disposed in a stored position which is substantially parallel to the under surface 70' of the platform 70. Alternately, it may be moved into an operative position as defined and disclosed in FIGS. 1 and 17.

Other structural members of the support means for the table assembly 70 include the outwardly extending gussets as at 76'. There should be at least one gusset assembly but a plurality of gusset assembly 76 may be utilized. Each such gusset assembly includes a gusset member pivotally attached to the under surface 70' of the platform 70 and positionable between a stored position in substantially parallel relation to the under surface 70' of the support platform 72 as shown in FIG. 16. The operative position is shown in FIGS. 1 and 17 of such gusset members 76'. The gussets 76' have their inner most peripheral edge as at 79 resting on or otherwise secured in supporting engagement along the outer surface of one or more of the wall panels defining the wall means as set forth above.

With regards to FIG. 14 and 15 yet another feature of the support means associated with the table assembly 70 is a support flap as at 90 which may be selectively positionable into and out of an operative position. The operative position shows the support flap engaging the under surface 70' of the support platform 72 of the table assembly 70. The stored position, due to a pivotal connection as at 92 allows the selective positoning of the flap 90 back into a stored position which is co-planer with at least one of the side panels 21 in which the support flap is formed. A recess is formed as at 94 which is configured and otherwise adapted to receive the support flap 90 back into its co-planer relation to the panel 21 in which it is mounted. A typical hinge pin or pivot pin as at 96 may define, at least in part, the pivotal connection of the hinge type attachment 92 of the support flap 90. A V-shaped indentation 97 is formed in the upper peripheral edge of the support flap 90 and is adapted to receive a congruently shaped, depending flange 99 secured to the under surface 70' of the platform 72. This engagement between the recess 97 and the flange 99 serves to secure the support flap 90 in its operative, supporting position as best shown in FIGS. 14 and 15.

Other features of the present invention include intergrally formed strengthening ribs 101 disposed and formed to extend outwardly from the inner surfaces of each of the side and back panels of each of the wall segments 16, 18 and 20.

Also as shown in FIGS. 4 and 19 a hose bib or mounting facility 102 is secured to an upper area of the back panel 29 of the upper most wall segment 20. This bib or mounting facility 102 is designed and adapted to allow penetration of a shower head and or attachment of a garden hose or like water supply thereto so that the person can take the water within the interior of the assembly 10.

Figure 21:
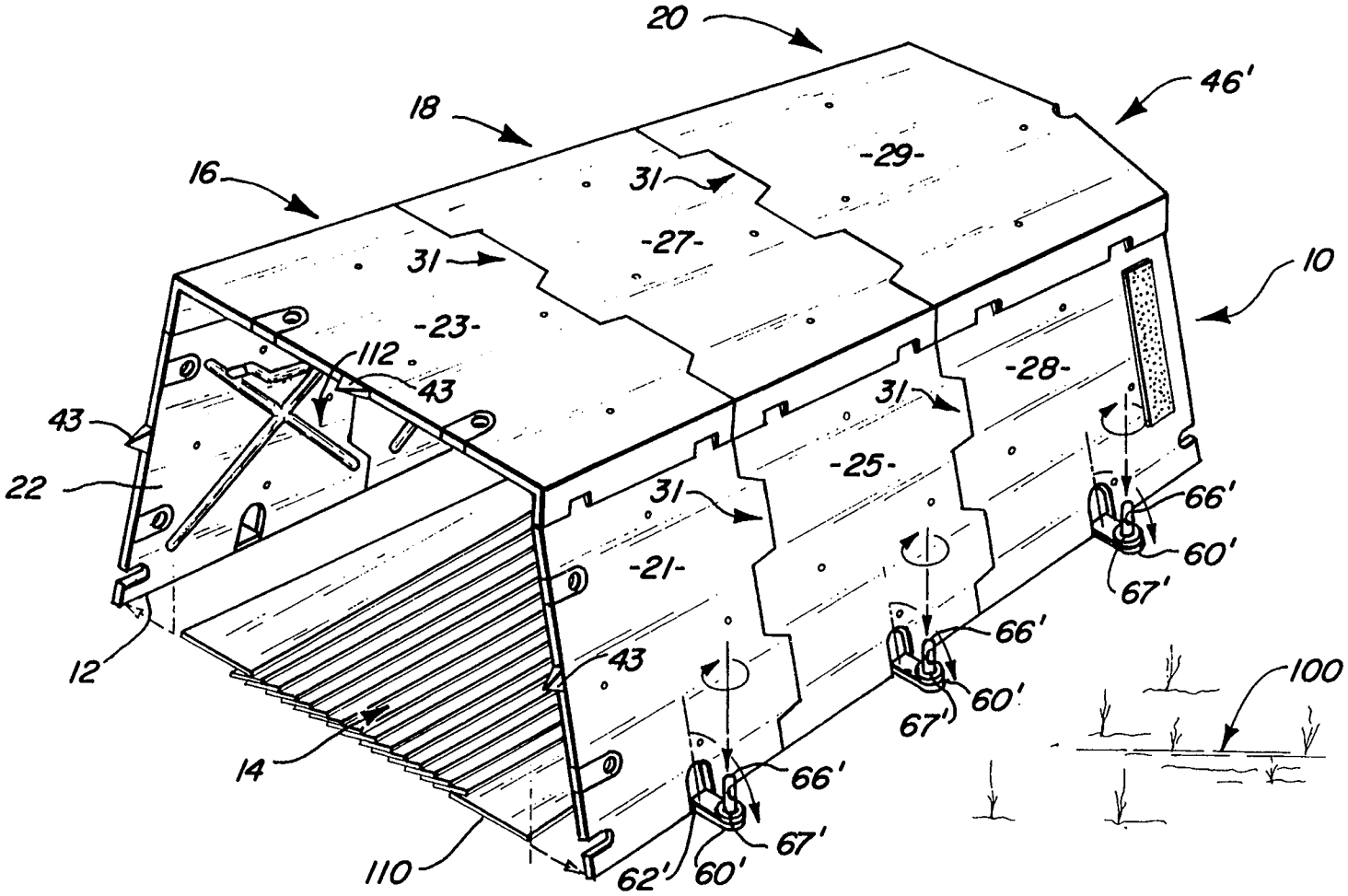
FIG. 21 is a perspective view of yet another embodiment of the present invention incorporating the same structural features as the embodiments described above.

With regards to the embodiment of FIG. 21, another structural advantage further indicating the great versatility of the enclosure assembly 10 is that it may be re-oriented so as to provide a protective cover or housing for a sleeping area. Such re-orientation takes the form of orienting the assembly 10 in a somewhat horizontal position such that the open access opening 12, extending along almost the entire length of the enclosure 10 is disposed in overlying relation to a ground 110 or like supporting surface. The curtain, flap or like cover structure 14 normally used to cover the access opening 12 when in its normal upright position as shown in FIGS. 1 and 2, may be specifically structured to have some type of a cushion or other inflatable structure which allows the curtain 14 to be used as a sleeping mat thereby adding comfort to one disposed in a reclined orientation and thereby using the curtain assembly 14 as a mattress type of structure and also to protect the user from dampness or being soiled from the ground supporting surface 110. The remainder of the structure remains the same with the exception that the end most base as pictured in FIG. 21 is of course opened and the bottom tie member 35 has been removed for easy and clear access. Such end opening now indicated generally as 112 could be covered by any type of bottom or end closure (not shown for purposes of clarity) in order to facilitate privacy of the like. Similarly a roof type structure generally indicated as 46' may be used to cover the other opposite end relative to the access opening 112. The remaining wall segment 16, 18 and 20 remain the same and in place and interconnect along the tongue and groove line 31 extending between the correspondingly positioned and cooperatively structured panels 21, 25, 28 and 23, 27, 29 of the various wall segments.

Anchor means in the form of flaps 60' may be movably or removably attached to correspondingly positioned side panels 21, 25, 28 and/or 22, 24, 26. Such anchor facilities include, set forth above, the flap 60' a movable or removable connection 62' and the removable stake 66' passing through the aperture 67' into the supporting ground surface 110.

It should be clear therefore based on the detailed explanation of the structural features of the present invention that great versatility is possible through the utilization of the subject structure and its components being interconnected in an operative manner as set forth above. Further it should be emphasized that the various components as described can be easily disassembled and arranged in some type of stacked or packaged array which facilitates the transporting of the entire assembly, in its disassembled form, from one location to another. When disassembled the structural components of this invention allow minimization of volume in any type of holding package in which the various components may be placed for travel or transportation. Now that the invention has been described:

What is claimed is:

1. A portable enclosure assembly adapted to house at least one person for purposes of taking a shower or like activity said assembly comprising;

a) a wall means adapted for at least partially surrounding and thereby defining a hollow interior portion of sufficient height and overall dimension to house a person therein, b) said wall means comprising a plurality of wall segments disposed in a substantially stacked array and extending along the length of said hollow interior, c) said plurality of wall segments comprising a lower most wall segment, an upper most wall segment and at least one middle wall segment disposed there between, d) each of said wall segments comprising a plurality of panels defined by at least three panels including two opposed, space depart side panels and a back panel interconnecting said side panels, said plurality of panels collectively disposed in at least partially surrounding relation to a portion of said hollow interior, e) attachment means disposed and adapted for removabally connecting correspondingly positioned panels of adjacent wall segments and being formed along an upper peripheral edge of said plurality of panels of said lower most wall segment and a lower peripheral edge of said plurality of panels of said upper most wall segment; said plurality of panels of said middle wall segment including said attachment means formed along both upper and lower peripheral edges thereof, f) each peripheral edge of said plurality of wall panels having said attachment means formed thereon being defined by a double row of alternating tongue and groove portions; each of two mating peripheral edges of adjacent panels adapted to removabally mount the plurality of tongue portions of one mating peripheral edge into the plurality of grooves of the other mating peripheral edge, and g) connecting means structurally adapted for interconnecting wall panels of at least one common wall segment.

2. An assembly as in claim 1 further comprising anchor means for anchoring said wall means on a support surface and secured to a lower most one of said plurality of wall segments and adapted to be positionable between an operative and a stored position.

3. An assembly as in claim 2 wherein said anchor means comprises a flange positionable outwardly from said lower most one of said plurality of wall segments to define said operative position and adapted to be attached to an anchor pin, said anchor pin adapted to extend outwardly from said anchor flange and into penetrating engagement with a support surface.

4. An assembly as in claim 1 wherein said plurality of wall segments each include a progressively lesser inner transverse dimension from a lower most wall segment to an upper most wall segment; said hollow interior configured to include a progressively decreasing inner transverse dimension along a height of said hollow interior from a lower end portion to an upper end portion.

5. An assembly as in claim 1 wherein said two spaced apart side panels of each wall segment include spaced apart free ends defining a segment of an access opening there between.

6. An assembly as in claim 5 wherein said access opening segment of said wall segments are correspondingly disposed to define an elongated access opening extending along a height of said hollow interior.

7. An assembly as in claim 1 wherein said connecting means comprises one tie panel extending between and in interconnecting relation with two spaced apart ones of said plurality of panels of at least one wall segment.

8. An assembly as in claim 7 wherein said connecting means comprises a first and a second tie panel each extending between and in interconnecting relation with two spaced apart panels of an upper most wall segment and a lower most wall segment respectively.

9. An assembly as in claim 1 further comprising a roof means for enclosing an upper open end of said hollow interior and adapted for removable supporting engagement on an upper most one of said plurality of wall segments.

10. A portable enclosure assembly adapted to house at least one person for purposes of taking a shower or like activity, said assembly comprising:

a) a wall means adapted for at least partially surrounding and thereby defining a hollow interior portion of sufficient length and overall dimension to house a person therein, b) said wall means comprising a plurality of wall segments disposed in a substantially stacked array and extending along the length of said hollow interior, c) each of said wall segments comprising a plurality of panels collectively disposed in at least partially surrounding relation to a portion of said hollow interior, d) attachment means formed on at least one peripheral edge of each of said plurality of panels and disposed and adapted for removably connecting correspondingly positioned panels of adjacent wall segments, e) connecting means structurally adapted for interconnecting wall panels of at least one common wall segment, and, f) a table assembly removably secured to an exterior of said wall means and selectively positionable between a collapsed position and an operable position.

11. An assembly as in claim 10 wherein said table assembly comprises a platform extending outwardly from said wall means when in an operative position and a support means securable at least in part to an under portion of said platform and selectively positionable between a supporting position and a stored position.

12. An assembly as in claim 11 wherein said support means comprises a leg assembly pivotally mounted to the under portion of the platform adjacent an outer end thereof and selectively positionable between said supporting position and a stored position.

13. An assembly as in claim 12 wherein said stored position is defined by a substantially co-planer, confronting relation of said leg assembly to an under surface of said platform.

14. An assembly as in claim 13 wherein said leg assembly further includes a main leg and two end slats each pivotally secured to a different, opposite longitudinal edge of said main leg and adapted to extend along a length thereof.

15. An assembly as in claim 13 wherein said support means further comprises at least one gusset member pivotally attached along one edge thereof to said under portion of said platform and including an adjacent peripheral edge disposable into and out of confronting engagement with an outer surface of said wall means.

16. An assembly as in claim 13 wherein said support means further comprises at least one support plate pivotally attached to said wall means and positionable outwardly from a co-planer relation to said wall means into supporting engagement with said under surface of said platform.

* * * * *